US007621533B2

(12) United States Patent
Kenny

(10) Patent No.: US 7,621,533 B2
(45) Date of Patent: Nov. 24, 2009

(54) BACCARAT INSURANCE GAME

(75) Inventor: James Thomas Kenny, Shorewood, IL (US)

(73) Assignee: Global Connection Development Ltd., San Centre (SG)

( * ) Notice: Subject to any disclaimer, the term of this patent is extended or adjusted under 35 U.S.C. 154(b) by 355 days.

(21) Appl. No.: 11/103,337

(22) Filed: Apr. 11, 2005

(65) Prior Publication Data

US 2006/0226605 A1 Oct. 12, 2006

(51) Int. Cl.
*A63F 1/00* (2006.01)

(52) U.S. Cl. ..... 273/292

(58) Field of Classification Search ..... None
See application file for complete search history.

(56) References Cited

U.S. PATENT DOCUMENTS 5,395,119 A * 3/1995 Jacob et al. ..... 273/274
5,957,459 A * 9/1999 Chae ..... 273/292
6,062,563 A * 5/2000 de Keller ..... 273/274
7,419,160 B1 * 9/2008 D'Ambrosio ..... 273/292
7,434,807 B2 * 10/2008 Wong ..... 273/274

* cited by examiner

*Primary Examiner*—Gene Kim
*Assistant Examiner*—Dolores Collins
(74) *Attorney, Agent, or Firm*—Banner & Witcoff, Ltd.

(57) ABSTRACT

Additional options for the placement of wagers in the game of baccarat are provided, to expand the potential interest and excitement of the game. The various betting or wagering options include different types of "insurance" in which the customer is buying insurance against the loss (or tie in certain cases) of the hand being insured. These optional wagers may be placed in addition to the traditional wagers on the Banker, Player, or Tie bets.

15 Claims, 3 Drawing Sheets

| ODDS | HAND TOTAL | |
|---|---|---|
| 2 TO 1 | 7 | TWO CARDS ONLY |
| 9 TO 1 | 8, 9 | TWO CARDS ONLY |
| 5 TO 1 | 7 | FOUR CARDS ONLY |

FIG 2

BACCARAT INSURANCE GAME

FIELD OF THE INVENTION

The present invention relates generally to gaming and casino games, and more specifically to different and heretofore unused methods of betting in the card game of baccarat. The methods are adaptable to both standard and so called "mini or midi-baccarat" games as well as to computer or electronic play.

BACKGROUND OF THE INVENTION

Casinos are constantly in search of increasing profits and correspondingly the excitement on the games they put before their customers. The casinos know that by adding "side bets" to existing games that profits will increase as well as the enjoyment of the game to the customer.

The need arises for a baccarat game to provide an additional bet to the traditional banker, player, and tie bet. Customers are discouraged in the play of the game when they have received a good hand total but still end up losing or tying their bet. The customers have no control of the outcome of the game and are helpless to make any kind of a decision that would help them make money on a perceived good hand. The baccarat game needs a side bet with a chance for the customer to protect losing all their money on a good hand. Like insurance in blackjack that can get the customer even money on their wager, insurance in baccarat can protect the customer from losing all their money, (or not getting paid because of a tie hand on a nine), on what they perceive as a good hand.

The rules of the game would not change and the outcome of all hands would be the same whether insurance was offered or not. If a customer only wanted to take insurance on certain hands or at certain times the results of the banker, player or a tie would not change. In certain cases the order of exposing the cards would be reversed from the traditional order but the results of the hand would still end up the same as the standard way.

DESCRIPTION OF THE PRIOR ART

U.S. Pat. No. 6,062,563 issued to David de Keller on May 16, 2000 discloses a Method of Playing a Casino game in which a dealer and a player both receive five cards or roll five dice to form a poker hand. The disclosure mentions an insurance wager only against the possibility of a tie hand. While the present invention provides for an insurance wager for a tie on a nine hand total, most of the wagers are for a loss of the hand insured. The present invention is directed only to use with the game of baccarat and not with the games of poker or craps.

U.S. Pat. No. 5,957,459 issued to Myung Chae on Sep. 28, 1999 discloses a Method of Playing a Banking game in which two hands are dealt which are counted similar to baccarat. The disclosure mentions an insurance wager against the possibility of a triple zero hand being made. Though similar in the counting of the hand total, Chae does not describe a baccarat game. The present invention is directed only with the game of baccarat and not with any other games.

SUMMARY OF THE INVENTION

By the present invention, improved wagering methods for the baccarat are disclosed.

Accordingly, one of the objects of the present invention is to provide baccarat wagering methods which generally expand upon the wagering options open to the customers of the game.

Another of the objects of the present invention is to provide improved baccarat wagering methods which include a provision for insurance, wherein a customer may protect a perceived good hand from a loss or in some cases a tie.

Yet another of the objects of the present invention is to provide a side bet with sufficiently large payoffs that would help increase the excitement of the game.

BRIEF DESCRIPTION OF THE DRAWINGS

FIG. 2 is one payout schedule for the insurance wager.

DETAILED DESCRIPTION OF THE PREFERRED EMBODIMENT

Figure 1:
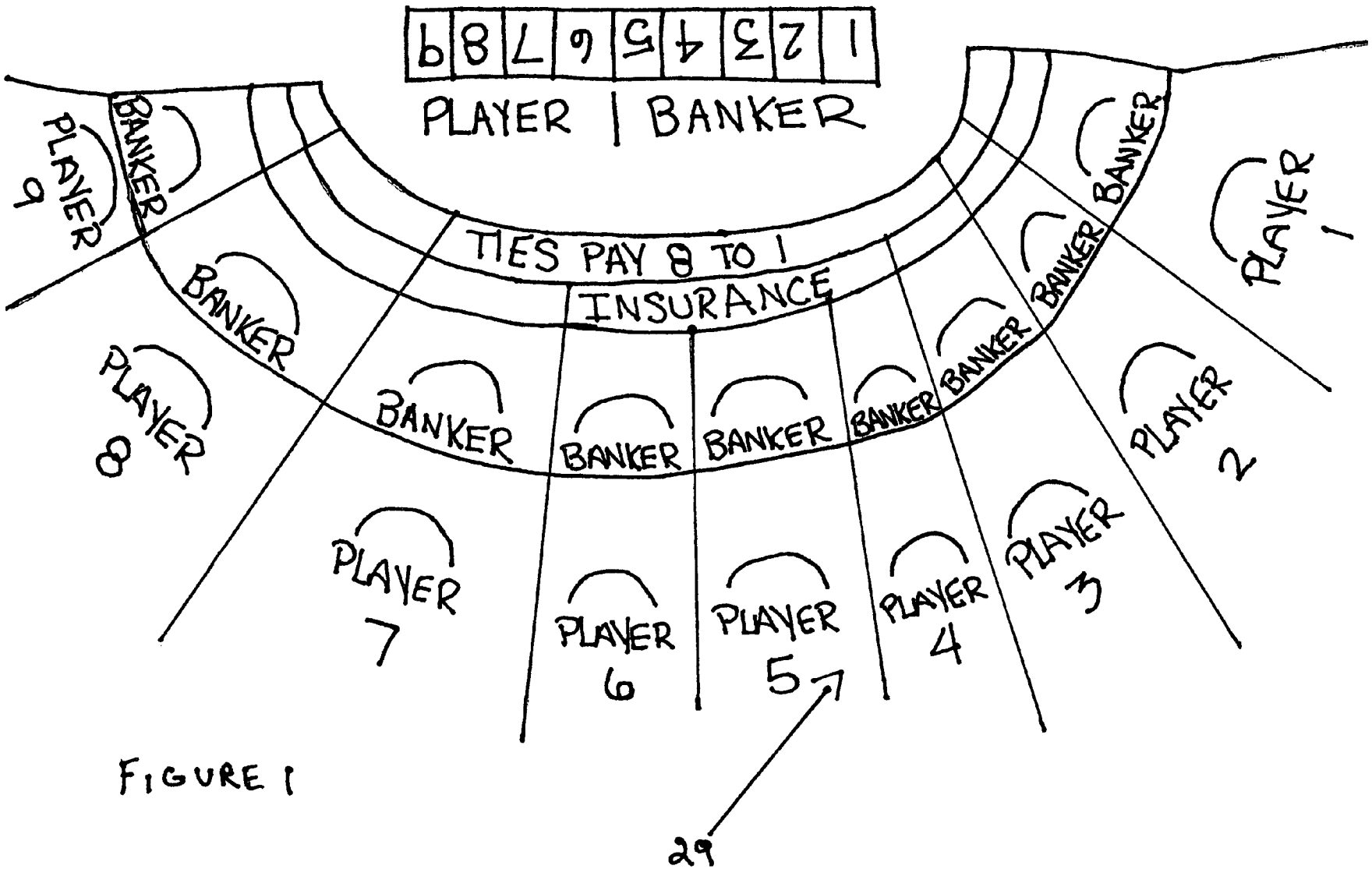
FIG. 1 is a plane view of a nine (9) seat baccarat table, showing the general layout and provision for the betting methods of the present invention.
Figure 1A:
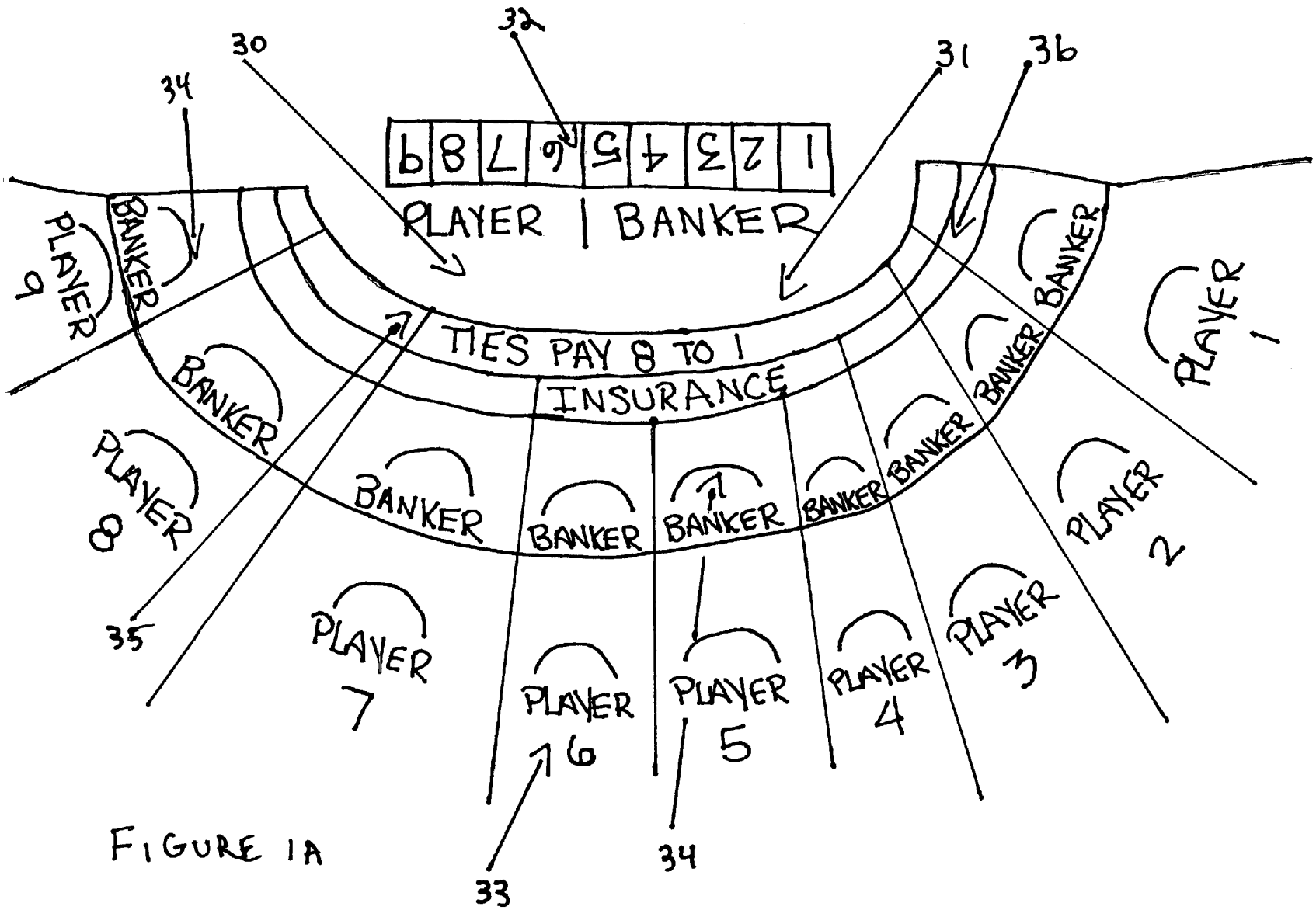
FIG. 1A is plane view of a nine (9) seat baccarat table, labeling the layout with the appropriate names for the different areas on the table.

Referring now to the drawings, the present invention will be seen to relate to various methods of providing wagering options in a baccarat game. FIGS. 1 and 1A disclose a baccarat table 29, which includes provision for the betting option of the present invention. FIG. 2 discloses one pay scale of the present invention. The present methods may be used in combination with a standard baccarat game using standard baccarat, Chemin de Fer, Scarney, baccarat banquet, Nevada or other rules, wherein up to twelve to sixteen customers may play, and may also be adapted for use with so called "mini or midi baccarat tables", which allows for play by one to nine customers.

In standard Nevada style baccarat, plural standard decks of cards, each having 52 cards of four suits, are used. The thirteen (13) cards in each suit comprise spot cards marked from one (ace) through ten, and court cards comprising the jack, queen, and king of each suit. Each of the spot cards is counted at face value, while each of the court cards is given a value of ten. Generally, six to eight decks are provided and contained in a "shoe" or container, from which the hands for the game are dealt. The object of the game is to achieve a total value of nine with the cards in the hand. It is not possible to "bust" or exceed nine, as the tens digit in any count exceeding nine is dropped, leaving only a single number between zero and nine (inclusive) as the value of the hand. The hand (either the player hand or the banker hand) which is closest to nine wins. Tie hands are a push on banker or player bets and customers who have wagered on the tie hand would win that bet. As the game is relatively simple and must be played according to specific rules governing the drawing of a third card after the initial two cards are drawn, the present methods of the invention add considerable interest and excitement to the game.

Insurance is only offered if there are more cards to be revealed and the hand being insured has a chance of being beaten or in the case of a nine total, being tied.

Insurance may only be offered once during a baccarat hand. Insurance may only be offered after the first two cards have been revealed (two cards only), after the second set of two cards has been revealed (four cards only), or after a third card has been given to one hand (five cards only) and there will be a third card given to the other hand. The offering of insurance in no way affects the outcome of the regular game of baccarat. All the hitting and standing rules remain the same. The opening order of the cards may change depending upon the house rules of each casino but the final outcome of all baccarat hands will be the same with or without insurance being offered. In some cases the dealer may turn over the initial two card hand of the banker before the initial two card hand of the player. This may be done depending upon the amount of money wagered on the banker and the player hand. If the largest wager is bet on the banker hand then the casino may have a house rule that the hand with the largest wager on it is revealed first.

With references to FIGS. 1 and 1A, the manner of play of a first embodiment of the present invention will now be described. Initially, all the customers place their bets, for either the player hand 30 in betting area 33, the banker hand 31 in the betting area 34, or for the tie hand in betting area 35. Commission would be placed in area 32. Two cards are dealt face down to the player hand and two cards are dealt face down to the banker hand. Traditionally the player hand would be revealed first so that the customers may determine the value of the hand. The present invention allows a customer the option of taking insurance in betting area 36, on certain initial two card hand totals (six to nine inclusive). The customer is basically insuring a perceived good hand total against a loss to the other hand. In the case of a nine hand total, the customer is insuring against the other hand also having a nine, in which case they would not get paid because their nine tied and did not win. Like in blackjack when a customer takes insurance, the customer wants to make sure they get some payment for having a good hand. The hand would be played out to its conclusion and if a six, seven, or eight hand was beaten or a nine hand tied, then the customer who took insurance would win the insurance bet and would be paid according to the posted pay scale.

If the initial player hand does not have a hand total from six to nine inclusive then no insurance would be offered and the bankers' two cards would be revealed. If the banker hand had a total of zero, one, two, three, eight, or nine then no insurance would be offered and the hand would play out according to the game rules. If the banker hand now had a total of four through seven and the player hand would be getting a third card, then insurance may be offered on the banker hand. The hand would be played to its conclusion and if the banker hand total of four, five, six, or seven was beaten then the insurance bet would win and be paid at the posted pay scale. All other cases the insurance bet would lose.

If the initial two card player hand and the initial two card banker hand have both been revealed and no insurance has yet been offered, insurance may be offered on the player hand after it is given a third card, according to the rules, and the player total is four through nine inclusive and the bank hand will also draw a third card. If in this case the player three card total of four, five, six, seven, or eight was beaten by the three card total of the banker hand, or if the player three card hand total of nine was tied by the three card total of the banker hand, then the insurance bet would win and be paid at the posted pay scale. If the player hand was not beaten by the banker hand or a player nine total tied by the banker hand, then the insurance bet would lose. In a second embodiment of the present invention, the initial two card hand of the banker would be revealed first. If the banker hand had a total of from six to nine inclusive, then insurance would be offered on the banker hand eventually losing on a six, seven, or eight, or tying on a nine total. If the customer took insurance on one of these hands and the hand lost or a nine was tied, then the customer would win the insurance bet and be paid according to the posted pay scale. All other cases would lose the insurance bet. If the banker hand had a zero, one, two, three, four, or five initial two card hand total, then no insurance would be offered and the initial two card player hand would then be revealed.

The initial two cards of the player hand would now be revealed which would make four cards exposed on the layout. These four cards revealed would be referred to on the pay scale as a four card hand or four cards only. If the player hand had a total of five and the banker hand, which was revealed first, had a total of four, then insurance may be offered on the player hand losing to the banker hand. Any other hand totals would not be offered insurance. If insurance was offered on the player hand total of five and the banker ended up winning, then insurance would be paid at the posted pay scale. If the player hand won, then the insurance bet would lose. If the hand total of the player hand (when revealed after the banker hand) is other than a five, then no insurance will be offered and the hand will be played out according to the rules.

If the initial two card banker hand and the initial two card player hand have both been revealed and no insurance has been offered, insurance may be offered on the banker hand after it is given a third card and has a total of four, eight, or nine and the player hand will draw a third card. If the four or eight hand is beaten or the nine hand is tied then the insurance bet will win at the posted pay scale. Any other case the insurance bet will lose.

In a third embodiment of the present invention, insurance would be offered only on a hand total of six, seven, eight, or nine, when more card totals would be revealed.

Insurance would only be offered after the initial first two cards have been revealed and after the second set of cards have been revealed when there was a draw to be made on the other hand. No insurance would be offered after a third card had been drawn. This method of the game would make it easier to deal and a faster paced game.

In a fourth embodiment of the present invention, insurance may be offered before any cards are revealed, after one card is revealed, after two cards are revealed, after three cards are revealed, after four cards revealed, or after five cards are revealed.

Insurance would be offered for any hand total. Any hand total under nine would have to be beaten or a nine hand total tied to win the insurance bet. All other cases would lose.

It is to be understood that the present invention is not limited to the sole embodiment described above, but encompasses any and all embodiments within the scope of the following claims.

I claim:

1. A method of playing a baccarat game, comprising:

a dealing step, wherein a hand of physical playing cards is dealt face down from at least one standard deck of playing cards comprising 52 cards, to form at least one player hand and a banker hand, each of at least two cards;

a player hand turning step, wherein the at least two cards of said at least one player hand are turned face up whereby customers at the game may view the player hand cards;

a banker hand turning step, wherein the at least two cards of said at least one banker hand are turned face up whereby customers at the game may view the banker hand cards;

an insurance offering step, wherein said customers are provided an opportunity to take insurance on the hand first turned face up if the sum of the value of said at least two cards of said hand is within a predefined range of hand total values that is based on whether the hand first turned up is the banker hand or is the player hand; and continuing play of said hand.

2. A method of playing a baccarat game according to claim 1, further comprising:

a second player hand turning step, wherein a third card is turned face up onto said player hand, if dictated by the rules of the game, whereby customers at the game may view said card; and a second insurance offering step responsive to the second player hand turning step, which provides an opportunity to said customers to take insurance if insurance has not already been offered, if the sum of the value of said player hand is now from four to nine inclusive, and the rules of the game provides for a draw of at least one more card.

3. A method of playing a baccarat game according to claim 1, wherein:

the banker hand turning step is performed before the player hand turning step; and the predefined range of hand total values is from six to nine inclusive.

4. A method of playing a baccarat game according to claim 3, further comprising:

a second insurance offering step subsequent to the player hand turning step, which provides an opportunity to said customers to take insurance if insurance has not already been offered, if the sum of the value of said at least two cards of said player hand is from five to seven inclusive, and if the rules of the game provide for a draw of at least one more card to said banker hand.

5. A method of playing a baccarat game according to claim 3, further comprising:

a second player hand turning step, wherein a third card is turned face up onto said player hand, if provided by the rules of the game, whereby customers at the game may view said card; and a second insurance offering step responsive to the second player hand turning step, which provides an opportunity to said customers to take insurance if insurance has not already been offered, if the sum of the value of said player hand is from five through nine inclusive, and if the rules of the game provide for a draw of at least one more card.

6. A method of playing a baccarat game according to claim 3, further comprising the subsequent steps of:

a second banker hand turning step, wherein a third card is turned face up onto said banker hand prior to said player hand, whereby customers at the game may view said card; and a second insurance offering step responsive to the second banker hand turning step, which provides an opportunity to said customers to take insurance if insurance has not already been offered, if the sum of the said banker hand is from five through nine inclusive, and the rules of the game provide for a draw of at least one more card.

7. A method of playing a baccarat game according to claim 1, further comprising the steps of:

offering said customers an opportunity to take insurance before any cards are revealed.

8. A method of playing a baccarat game according to claim 1, further comprising the steps of:

offering said customers an opportunity to take insurance after at least one card has been revealed.

9. A method of playing a baccarat game according to claim 1, further comprising the steps of:

offering said customers an opportunity to take insurance after zero, one, two, three, four, or five cards of any totals have been revealed.

10. A method of playing a baccarat game according to claim 1, further comprising the steps of:

taking the insurance wager of said customers who have taken insurance, if the hand wins; and paying said customers according to the posted pay scale who have taken insurance on a hand total that was beaten or who have taken insurance on a nine hand total which was tied.

11. A method of playing a baccarat game according to claim 1, wherein:

the player hand turning step is performed before the banker hand turning step; and the predefined range of hand total values is from six to nine inclusive.

12. A method of playing a baccarat game according to claim 11, further comprising:

a second insurance offering step subsequent to the banker hand turning step, which provides an opportunity to said customers to take insurance if insurance has not already been offered, if the sum of the value of the at least two cards of said banker hand is from four to seven inclusive, and if the rules of the game provides for a draw of at least one more card by the banker.

13. A method, comprising:

accepting a wager from at least one player in a game of baccarat;

dealing face down from at least one standard deck of physical playing cards comprising 52 cards, at least one player hand and a banker hand, each of at least two cards;

turning the at least two cards of said at least one player hand face up whereby the player hand cards are visible;

turning the at least two cards of said banker hand face up whereby the banker hand cards are visible;

after one of said turning steps and prior to a second of said turning steps, offering insurance to players of the game of baccarat wherein said players may take insurance on said wager if said wager is on the hand first turned face up and if the sum of the value of said at least two cards of said face up hand is a predefined range of hand total values based on whether the hand first turned up is the banker hand or is the player hand; and continuing play of said hand.

14. The method of claim 13, wherein the at least one player hand is turned face up prior to said banker hand, and wherein the predefined range of hand total values is six to nine inclusive.

15. The method of claim 13, wherein the banker hand is turned face up prior to said at least one player hand, and wherein the predefined range of hand total values is six to nine inclusive.

* * * * *